US006998586B2

(12) United States Patent
Kitada

(10) Patent No.: US 6,998,586 B2
(45) Date of Patent: Feb. 14, 2006

(54) DEVICE FOR HEATING ARTICLE TO BE TREATED

(75) Inventor: Masayoshi Kitada, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/508,021

(22) PCT Filed: Feb. 17, 2003

(86) PCT No.: PCT/JP03/01648

§ 371 (c)(1),
(2), (4) Date: Sep. 16, 2004

(87) PCT Pub. No.: WO03/079726

PCT Pub. Date: Sep. 25, 2003

(65) Prior Publication Data

US 2005/0127062 A1 Jun. 16, 2005

(30) Foreign Application Priority Data

Mar. 20, 2002 (JP) ..... 2002-077536

(51) Int. Cl.
*H05B 3/42* (2006.01)
*H05B 3/50* (2006.01)
*H05B 3/10* (2006.01)
*H05B 3/20* (2006.01)

(52) U.S. Cl. ..... 219/530; 219/540; 219/548; 219/411; 392/486

(58) Field of Classification Search ..... 219/411, 219/540, 547, 548, 552, 553
See application file for complete search history.

(56) References Cited

U.S. PATENT DOCUMENTS

| | | | | | |
|---|---|---|---|---|---|
| 2,967,225 | A | * | 1/1961 | Carrier, Jr. et al. | 219/540 |
| 3,163,841 | A | * | 12/1964 | Willett | 392/485 |
| 3,413,441 | A | * | 11/1968 | Isobe et al. | 219/390 |
| 4,825,868 | A | * | 5/1989 | Susa et al. | 219/553 |
| 4,990,755 | A | * | 2/1991 | Nishimura | 219/553 |
| 5,077,461 | A | * | 12/1991 | Hasegawa | 219/553 |
| 5,408,071 | A | * | 4/1995 | Ragland et al. | 219/530 |
| 5,519,191 | A | * | 5/1996 | Ketcham et al. | 392/485 |

FOREIGN PATENT DOCUMENTS

| | | | | |
|---|---|---|---|---|
| JP | 47-25731 | | | 10/1972 |
| JP | 63-135726 | A | * | 6/1988 |
| JP | 02-155185 | A | * | 6/1990 |
| JP | 02-282462 | A | * | 11/1990 |
| JP | 3-4690 | | | 1/1991 |
| JP | 11-218338 | A | * | 8/1999 |
| JP | 2002-282037 | A | * | 10/2002 |

* cited by examiner

*Primary Examiner*—Joseph Pelham
(74) *Attorney, Agent, or Firm*—Hamre, Schumann, Mueller & Larson, P.C.

(57) ABSTRACT

The present invention provides heating equipment of a treated substance designed so as to be equipped with any foil of a metallic material or non metallic material for heating the treated substance, and a heating mechanism for heating the foil to a temperature where a far infrared ray is radiated, and to heat the treated substance by the far infrared ray radiated from the foil. The heating efficiency in heating the treated substance by the far infrared ray can be made higher than conventional heating equipment. Meanwhile, the present invention has been found on the basis of experimental results where heating tests of water are performed with using the foil and wire of an aluminum material.

12 Claims, 4 Drawing Sheets

Relationship Between Sectional Shape and Electric Resistance Value of Aluminum Material Relationship Between Sectional Shape and Electric Resistance Value of Copper Material Heating Portion+Electric Resistance of Conducting Wire(mΩ): Total 118.32~119.83

Heating Portion+Electric Resistance of Conducting Wire(mΩ): Total 118.32~119.83

DEVICE FOR HEATING ARTICLE TO BE TREATED

FIELD OF THE INVENTION

The present invention relates to heating equipment of a treated substance heated through a far infrared ray generated by heating a metallic material foil or non-metallic material foil.

BACKGROUND OF THE INVENTION

Generally, as a mechanism for heating a treated substance is known a far infrared ray heater. Conventionally, the infrared ray heater is utilized in a wide range of fields such as housing related, semiconductor related, chemical product related, and food related ones other than such as pre-heating, heating, painting and drying, and annealing of various parts of an automobile related field.

In these far infrared ray heaters there are generally a bar form, a lamp form, and a plate form; and any of them makes a heating wire a heat source. In a radiation body there are two kinds, one nothing but ceramics and the other where the ceramics is deposited on a surface of a metallic body. In addition, although in heating of the far infrared rays heater heating element and the like are used, a method of not using the heating element and the like, for example, performing heating with using semiconductor ceramics and dielectric ceramics is becoming mainstream.

As characteristics of these far infrared ray heaters, following ones can be cited:

(1) These are mainly suitable to surface heating.

(2) A heating time can be shortened from an hour order to a minute order because swift and effective heating can be achieved, compared to a resistance furnace.

(3) An operation is simple; a temperature adjustment is easy; and a time delay is extremely a few.

(4) Equipment cost is a little and a needed area comes off with a smaller one.

Meanwhile, in far infrared ray heaters there exists no heater for radiating nothing but a far infrared ray and the far infrared ray certainly accompanies radiations of other infrared rays.

However, conventionally, there is an insufficient phase on a study for solid radiation materials of these far infrared ray heaters, for example, metals, non metals, alloys, oxides, and the like; and this time the inventors selected an aluminum material used much in an automobile as a typical metal and a copper material as a conducting wire of electric wiring, were devoted to studying them, resultingly obtained meaningful knowledge, and got to find the present invention based thereon.

The present invention is made to solve the problems described above and makes it a purpose to provide heating equipment of a treated substance that can make a heating efficiency higher than that of conventional heating equipment when heating the treated substance by a far infrared ray.

DISCLOSURE OF THE INVENTION

Equipment of a treated substance of the present invention comprises any foil of a metallic material or non metallic material for heating the treated substance and a heating mechanism for heating the foil to a temperature where a far infrared ray is radiated from the foil; and the equipment is designed so that the treated substance is heated by the far infrared ray radiated through the foil.

By comprising any foil of the metallic material or non metallic material for heating the treated substance and the heating mechanism for heating the foil to the temperature where the far infrared ray is radiated from the foil and being designed so that the treated substance is heated by the far infrared ray radiated through the foil, the equipment of the treated substance with the foil can make a heating efficiency higher than that with a wire of a same sectional area.

In the equipment of the treated substance, by making a thickness of the foil 6 to 20 microns, a radiation amount of the far infrared ray absorbed in the treated substance is augmented and thus the treated substance can be made to become suitably heated.

Because the equipment of the treated substance can improve heat reflectiveness by making the metallic material aluminum (heat emitted from aluminum is not absorbed in the aluminum), it can make the heating efficiency higher than that with a wire of a same sectional area.

DESCRIPTION OF THE PREFERRED EMBODIMENTS

Here will be concretely described heating equipment of a treated substance related to the present invention, referring to FIGS. 1 to 6C.

Firstly will be described developments (examples) before getting to find the present invention, referring to FIGS. 1 to 5B. Meanwhile, water (refined one) is used as the treated substance and a resistance wire heating mechanism using a direct current (DC) power source is used as a heating mechanism.

EXAMPLE 1

Figure 1:
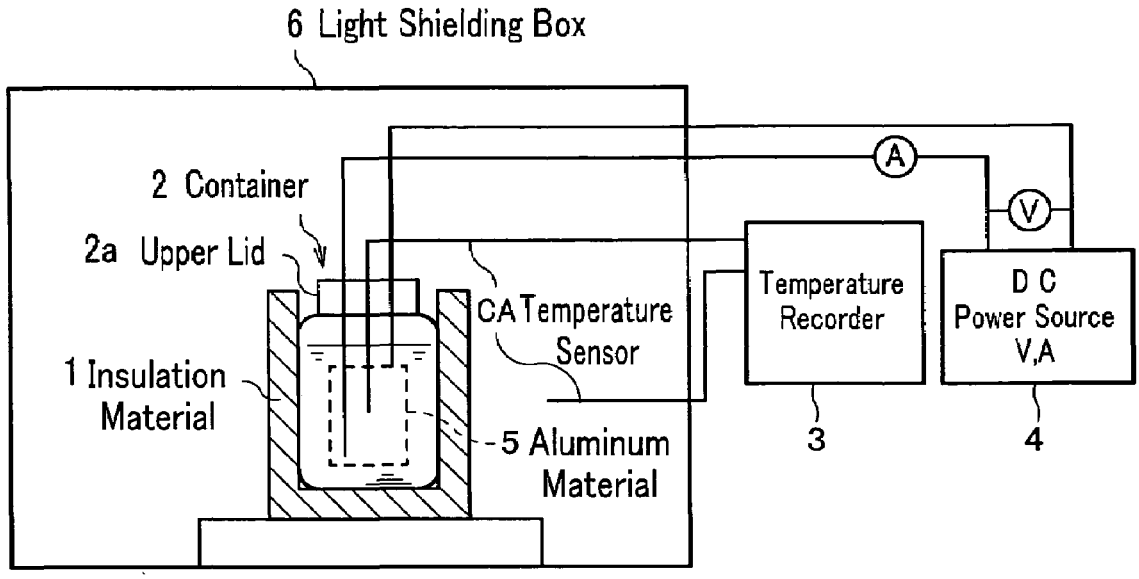
FIG. 1 is an experimental apparatus used in examples.
Figure 2:
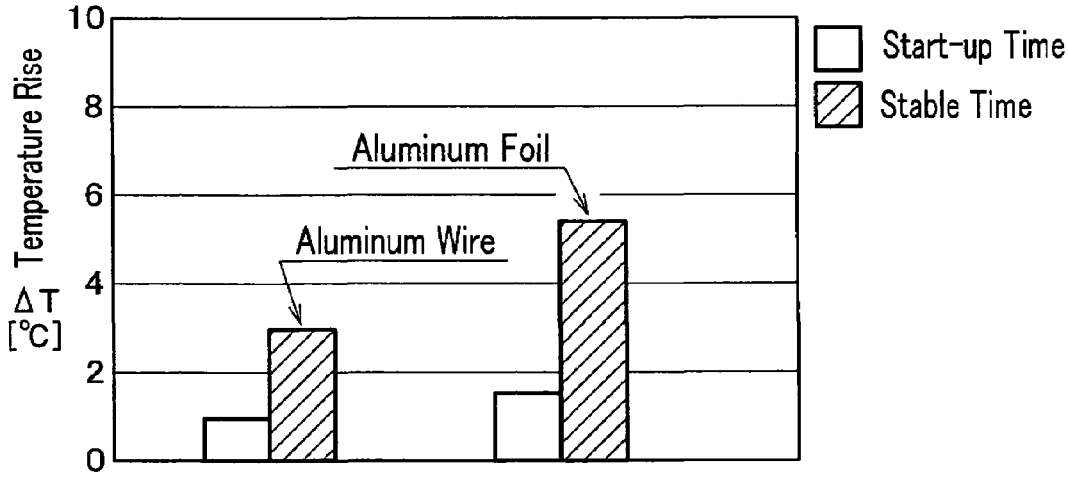
FIG. 2 is a drawing showing experimental results when performing heating tests with inputting same electric power to a respective wire and foil of an aluminum material whose electric resistance values are made same.

FIG. 1 is an experimental apparatus used in the examples. FIG. 2 is a drawing showing experimental results when performing heating tests with inputting same electric power to a respective wire and foil of an aluminum material whose electric resistance values are made same. First referring to FIG. 1, the experimental apparatus will be described.

Main portions of the experimental apparatus comprises a container 2 whose circumference is surrounded by an insulation material 1 and whose upper portion is closed with an upper lid 2*a*; a temperature recorder 3 for measuring a temperature difference value (temperature rise) between a 'before-heating temperature' and a heating-finish-time temperature of a constant amount of water thrown in the container 2 and a temperature within a light shielding box 6, with inserting temperature sensors CA in the container 2 and within the light shielding box; an aluminum material 5 (any of a foil and a wire) which is fixed and held in the container 2, to which electric power is inputted by a DC power source 4 from outside and which heats the water (refined one); the light shielding box 6 for shielding light invading from outside to inside of the container 2.

The experimental apparatus thus composed is operated as follows:

(1) Remove the light shielding box 6 from the experimental apparatus, open the upper lid 2*a* of the container 2 surrounded by the insulation material 1 (for example, 30 mm in thickness), and fix/hold the aluminum material 5 (any of the foil and the wire) within the container 2.

(2) Throw a constant amount of water in the container 2. At this time, hold a liquid surface so as to be certainly higher than an upper end of the aluminum material 5 (any of the foil and the wire). Then, close the upper lid 2*a*.

(3) Cover all of the experimental apparatus with the light shielding box 6. This reason is to avoid an influence on an experimental result by an interaction between the metal and light.

(4) Make a switch of the temperature recorder 3 ON.

(5) Make a switch of the DC power source 4 ON. Always supply constant electric power to the aluminum material 5 (any of the foil and the wire), and record values of a current and a voltage when heating of water is started.

(6) Derive temperature rise (temperature difference) of the water from a before-starting temperature thereof and its final temperature after heating for a predetermined time.

(7) Derive respective heating efficiencies of the foil and the wire from a following expression defined as below, comparing the constant electric power given to the water with energy (which can be derived from the temperature rise, specific calorie of water, and a thrown-in amount of the water) obtained by the water.

Heating efficiency=(Heat used for ascending a temperature of water)/(Total electric power input for heating a heater)

Next will be described results of heating tests of water performed in the experimental apparatus, referring to FIG. 2.

As also proven from FIG. 2, in heating water (refined one) with using a respective aluminum wire and foil whose sectional areas are equal, when comparing temperature rise at a 'start-up time' whose heating time is short (for example, one hour after heating) and a 'stable time' whose heating time is long (for example, six hours after heating) with making an input value of electric power and an electric resistance value constant and then performing the heating, the temperature rise (temperature difference between a temperature of make-up water and a water temperature after heated for the predetermined time) of the aluminum foil is larger than that of the aluminum wire in both cases by not less than 50%.

Accordingly, it turns out that comparing the wire with the foil, the latter is higher than the former in the heating efficiency.

EXAMPLE 2

Figure 3:
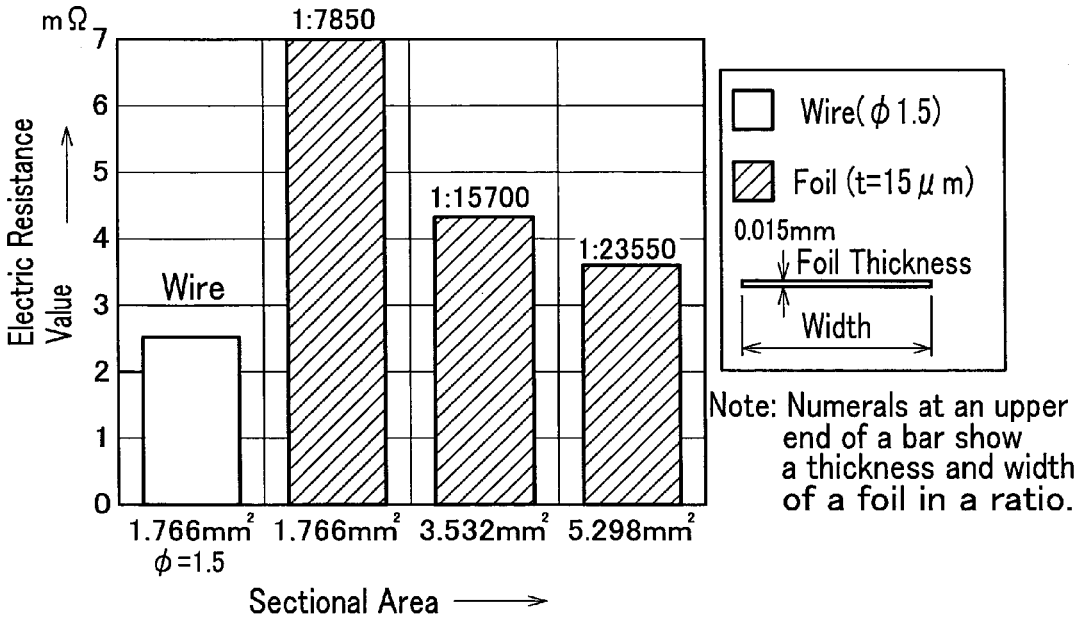
FIG. 3 is a drawing for illustrating a relationship between a sectional shape and electric resistance value of an aluminum material.
Figure 4:
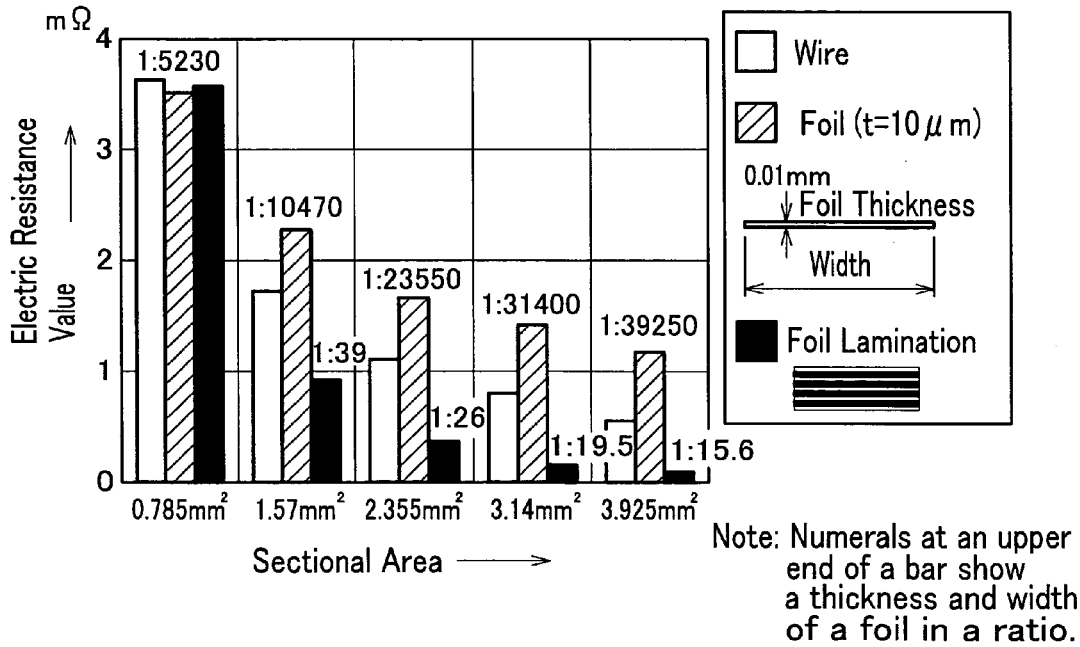
FIG. 4 is a drawing for illustrating a relationship between a sectional shape and electric resistance value of a copper material.

Next, based on the knowledge described above, are measured relationships between a sectional shape and electric resistance value of an aluminum material and copper material not in water as the Example 1 but in an atmosphere. Measurement results then are shown in FIGS. 3 and 4. Meanwhile, FIG. 3 is a drawing for illustrating a relationship between the sectional shape and electric resistance value of the aluminum material. FIG. 4 is a drawing for illustrating a relationship between the sectional shape and electric resistance value of the copper material.

Firstly will be described the relationship between the sectional shape and electric resistance value of the aluminum material, referring to FIG. 3.

In the relationship between the sectional shape and electric resistance value of the aluminum material, as also proven from FIG. 3, although the electric resistance value of the foil shows a large value of 7 mΩ (2.8 times of the wire) in a small region (1.766 $mm^2$) of the sectional area, compared to an electric resistance value of 2.5 mΩ of the wire with a same sectional area as the foil, the electric resistance value of the foil becomes smaller than 7 m Ω in a large region of over 1.766 $mm^2$ in the sectional area of the foil.

EXAMPLE 3

Next is shown the relationship between the sectional shape and electric resistance value of the copper material. In the relationship between the sectional shape and electric resistance value of the copper material, as also proven from FIG. 4, although a difference of electric resistance values between the wire and the foil is a few in a small region (0.785 $mm^2$) of the sectional area, the foil becomes larger (the differences of electric resistance values are substantially constant) than the wire in the electric resistance values as the sectional area becomes larger (over 0.785 $mm^2$). In addition, something laminated with the foil and made into a same sectional area as the wire is small in the electric resistance values even if compared to the wire and the foil.

Thus also with respect to a metal other than aluminum, in a foil and a wire with a same sectional area the former is larger than the latter in the electric resistance value. That is, it turns out that joule heat necessary for performing heating can be obtained more in the foil.

EXAMPLE 4

Next, based on these knowledge, making the electric resistance value of a foil and wire of an aluminum material same (including the electric resistance value of a conducting wire) and input electric power constant, will be described experimental results when tests for heating water with any of the foil and wire of the aluminum material, referring to FIGS. 5A and 5B.

Figure 5A:
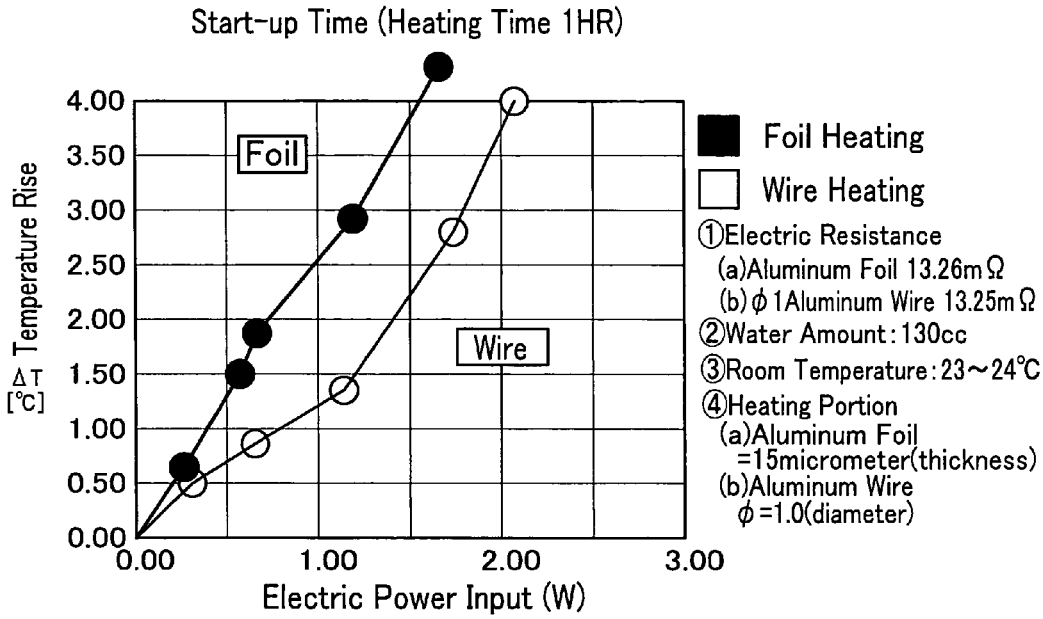
FIG. 5A is a drawing showing results of heating tests when making input electric power constant and performing heating for a short time of one hour from a heating start-up.

Meanwhile, FIG. 5A is a drawing showing results of heating tests when making input electric power constant and performing heating for a short time of one hour from a heating start-up; FIG. 5B is a drawing showing results of heating tests when making input electric power constant and performing heating for a long time of six hours from the heating start-up.

Figure 5B:
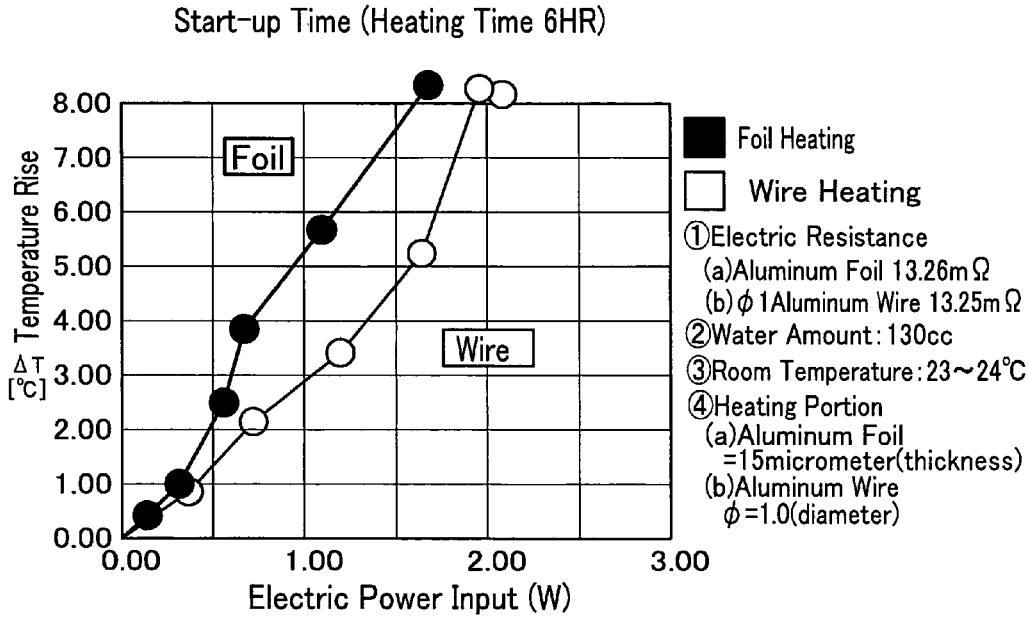
FIG. 5B is a drawing showing results of heating tests when making input electric power constant and performing heating for a long time of six hours from the heating start-up.

As also proven from FIGS. 5A and 5B, it turns out that the foil of the aluminum material is larger than the wire of the aluminum material in the temperature rise, heating efficiency, not depending on a heating time. From such the experimental results, it turns out that making a shape a foil rather than a wire makes the heating efficiency higher when the sectional area is made same.

As reasons causing such a phenomenon, the inventors assume following ones:

(1) If electric power is passed through the foil of the aluminum material, a stationary wave of a far infrared ray is formed within the aluminum material and the far infrared ray is radiated from a point that becomes a crest or trough of the wave thereof to outside. Because in the far infrared ray generated at this time there are many wavelengths of around 10 $\mu$m easy to be absorbed in water, a force for heating water seems to become stronger than that for heating the water with an ordinary heater.

(2) Actually, with respect to a thickness of the foil of the aluminum material, although a force for activating water is strong till 20 $\mu$m or so, the heating efficiency of water decreases if the thickness becomes larger than 30 $\mu$m.

(3) In addition, by making the metallic material aluminum, because the reflectiveness of heat can be improved (heat emitted from aluminum is not absorbed in the aluminum), it seems that the heating efficiency of water can be made higher.

Figure 6A:
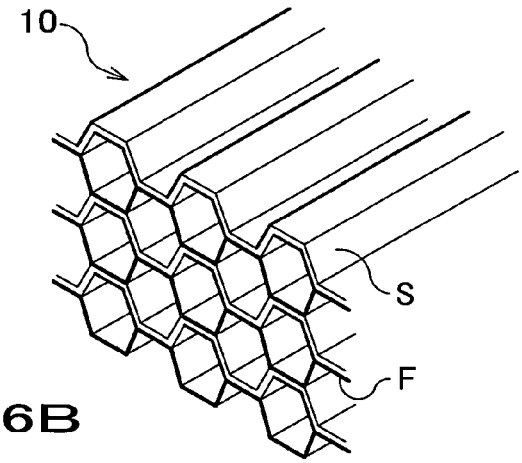
FIG. 6A is a drawing for illustrating a first embodiment of heating equipment of a treated substance related to the present invention.
Figure 6B:
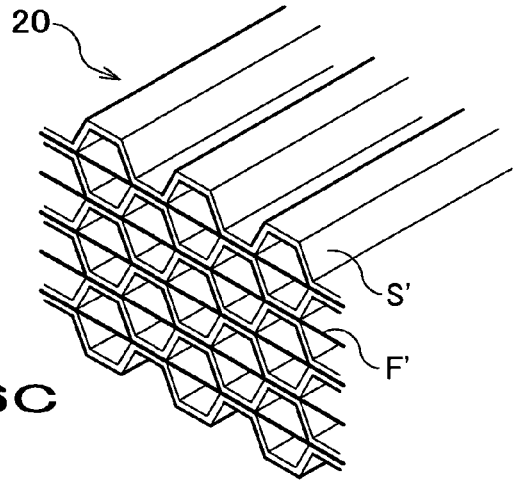
FIG. 6B is a drawing for illustrating a second embodiment of the heating equipment of the treated substance related to the present invention.
Figure 6C:
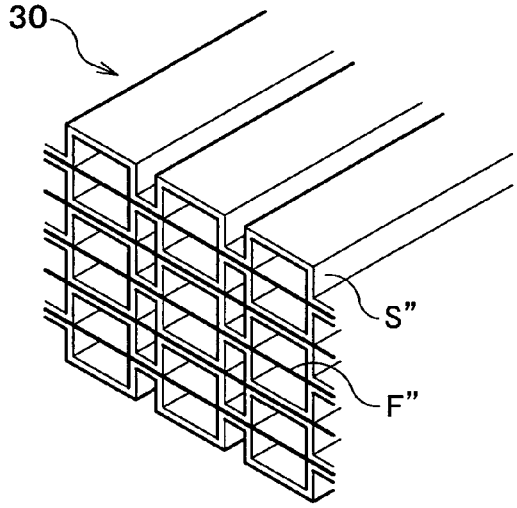
FIG. 6C is a drawing for illustrating a third embodiment of the heating equipment of the treated substance related to the present invention.

Next will be described embodiments of heating equipment of a treated substance related to the present invention found on the basis of these knowledge, referring to FIGS. 6A to 6C. Meanwhile, FIGS. 6A to 6C are drawings for illustrating first to third embodiments of heating equipment of the treated substance related to the present invention. In addition, as same in the examples water (refined one) is used as the treated substance and the resistance wire heating mechanism using a DC power source is used as a heating mechanism.

Meanwhile, even if intending to make the sectional area of the foil of the aluminum material described above same as that of the wire of the aluminum material, that cannot be made same without lengthening a lateral directional length of the foil at any cost because the foil is thinner than the wire in thickness. Subsequently, the inventors have thought of an arrangement for effectively utilizing the lateral direction of the foil in heating water.

In addition, partitioning a water flow channel into a plurality of cells in order to uniformly heat a large amount of water in a short time, it is designed so that an amount of water as much as matching a heating capacity of each cell is passed through each cell.

Main portions of heating equipment 10 of the treated substance of the first embodiment related to the present invention is formed of foils F of such an aluminum material shown in FIG. 6A, for example, a thickness of 15 $\mu$m of the foil, and hold members S for holding the foils F.

The heating equipment 10 of the treated substance is a heater, whose sectional shape is a honeycomb shape, and a shape of each cell is hexagonal.

In addition, a half of sides of hexagons are formed of the foils F of the aluminum material.

Pulling out nothing but members of the foils F of the aluminum material, they are a substantially same shape as the hold members S, where a trapezoid without a lower bottom and a reverse trapezoid without an upper bottom are alternately linked.

In the heating equipment 10 of the treated substance of the first embodiment is thus formed a honeycomb structural body, alternately stacking the members so that respective crests of the hold members S correspond to respective troughs of the foils F up and down and respective troughs of the hold members S correspond to respective crests of the foils F up and down.

Fluid, for example, water is passed through a hollow portion of the honeycomb structural body. Meanwhile, when the heating equipment 10 of the treated substance of the first embodiment is used as large-size heating equipment of a treated substance, electric power is supplied to the foils F of the aluminum material from a DC power source through a busbar.

Next will be described heating equipment of a treated substance of the second embodiment, referring to FIG. 6B.

Heating equipment 20 of the treated substance of the second embodiment is equipment designed to be supported and fixed by pinching foils F' of an aluminum material up and down with using hold members S', where a trapezoid without a lower bottom and a reverse trapezoid without an upper bottom are alternately linked.

In other words, respective foils F' of the aluminum material are pinched with respective trough portions of an upper stage of hold members S' and respective crests portions of an lower stage of hold members S'; and neighboring cells are provided so that the crests portions of the lower stage of respective hold members S' and the trough portions of the upper stage of respective hold members S' correspond up and down, interleaving the respective foils F' of the aluminum material.

In accordance with such the structure a simple structural body cab be manufactured with interleaving the foils F' of a sheet-form aluminum material as they are, and thereby complicated bending work (extrusion molding) of a foil of the aluminum material such as the infrared ray heater of the first embodiment becomes unnecessary. In addition, hold strength of the foils F' of the aluminum material can be heightened as much as the hold members S' become more.

Next will be described heating equipment of a treated substance of the third embodiment, referring to FIG. 6C.

As shown in FIG. 6C, heating equipment 30 of the treated substance of the third embodiment is equipment designed to be supported and fixed by pinching foils F" of an aluminum material up and down with replacing the hold members S', where the trapezoids of the second embodiment are linked, with hold members S", where rectangles without respective bottom sides and those without respective top sides are alternately linked. That is, same as in the heating equipment 20 of the treated substance of the second equipment, respective foils F" of the aluminum material are pinched with respective trough portions of an upper stage of hold members S" and respective crests portions of an lower stage of hold members S"; and neighboring cells are provided so that the crests portions of the lower stage of respective hold members S" and the trough portions of the upper stage of respective hold members S" correspond up and down, interleaving the respective foils F" of the aluminum material.

The heating equipment 30 of the treated substance of the third embodiment is a variation example of the hold members of the heating equipment 20 of the treated substance of the second embodiment and is weaker than the latter for a compression pressure from outside.

When distributing water for each cell, passing it through the heating equipment of the treated substance from the first to third embodiments, and heating the water with supplying electric power, the heating efficiency per electric power, which is input to the heating equipment of the treated substance, has been more improved than that of conventional heating equipment. In addition, whole water can be uniformly heated in a time shorter than in the conventional heating equipment.

The present invention is not limited to the heating equipment of the treated substance of the first to third embodiments described above and can be implemented without departing from the spirit and scope of the invention.

For example, in the hold members for pinching and supporting the foils of the aluminum material, a same sectional shape thereof is not repeated but also changeable.

Although in the embodiments the examples are described with respect to heating water, liquid other than the water, for example, a hydrogen-containing organic compound can also be heated.

In addition, even if a treated substance to be heated is fluid other than the liquid, for example, even a gas, it can be heated by appropriately changing the thickness of the foils.

INDUSTRIAL APPLICABILITY

In accordance with the present invention comprised of configurations and actions thus described, the following effects can be obtained:

(1) The heating equipment of a treated substance is designed so as to comprise any foil of a metallic material or non metallic material for heating the treated substance, and a heating mechanism for heating the foil to a temperature where a far infrared ray is radiated, and to heat the treated substance by the far infrared ray radiated from the foil; and thereby the heating efficiency of the treated substance can be made higher than that in a wire of a same sectional area.

(2) By making the thickness of the foil of the aluminum material 6 to 20 $\mu$m, a radiation amount of the far infrared ray absorbed in the treated substance is augmented and thereby the treated substance can be suitably heated.

(3) By making the metallic material aluminum, because heat reflectiveness can be improved (heat emitted from aluminum is not absorbed in the aluminum), the heating efficiency of the treated substance can be made higher than that in a wire of a same sectional area.

What is claimed is:

1. Heating equipment of a treated substance comprising:

at least two hold members, the hold members including a plurality of cells therebetween, the cells including flow channels therein;

any foil of a metallic material or non metallic material for heating said treated substance, the foil being disposed between the hold members and adjacent the flow channels; and a heating mechanism for heating said foil to a temperature where a far infrared ray is radiated, wherein said treated substance is heated by said far infrared ray radiated from said foil.

2. Heating equipment of a treated substance according to claim 1, wherein a thickness of said foil is from 6 to 20 $\mu$m.

3. Heating equipment of a treated substance according to claim 1, wherein said metallic material is aluminum.

4. Heating equipment of a treated substance according to claim 1, wherein the hold members and foil are alternately stacked.

5. Heating equipment of a treated substance according to claim 1, further comprising a plurality of hold members and foils alternately stacked.

6. Heating equipment of a treated substance according to claim 1, wherein the foil and one of the hold members form a sectional shape being a honeycomb shape and the cells being a hexagonal shape.

7. Heating equipment of a treated substance according to claim 6, wherein the foil and one of the hold members having substantially a same shape, the same shape defining an open trapezoid without a lower bottom and a reverse open trapezoid without an upper bottom, such that they are linked to form the cells with the hexagonal shape.

8. Heating equipment of a treated substance according to claim 1, wherein the foil is pinched between the hold members.

9. Heating equipment of a treated substance according to claim 1, wherein the hold members having substantially a same shape, the same shape defining an open trapezoid without a lower bottom and a reverse open trapezoid without an upper bottom, such that they are linked to from the cells wit a hexagonal shape.

10. Heating equipment of a treated substance according to claim 9, wherein the foil is pinched between the hold members, such that the hold members interleave the foil.

11. Heating equipment of a treated substance according to claim 1, wherein the hold members having substantially a same shape, the same shape defining an open rectangle without a lower bottom and a reverse open rectangle without an upper bottom, such that they are linked to form the cells with a closed rectangular shape.

12. Heating equipment of a treated substance according to claim 11, wherein the foil is pinched between the hold members, such that the hold members interleave the foil.

* * * * *